United States Patent [19]

Takasu et al.

[11] 4,097,277

[45] Jun. 27, 1978

[54] PHOTOSENSITIVE MEMBER HAVING LAYER OF VINYL CARBAZOLE POLYMER CONTAINING ANTIMONY CHALCOGEN COMPOUND OF ANTIMONY AND SULFUR

[75] Inventors: Yoshio Takasu, Tokyo; Eiichi Kondo, Kawasaki, both of Japan

[73] Assignee: Canon Kabushiki Kaisha, Japan

[21] Appl. No.: 749,974

[22] Filed: Dec. 13, 1976

Related U.S. Application Data

[63] Continuation of Ser. No. 436,747, Jan. 25, 1974, abandoned.

[30] Foreign Application Priority Data

Jan. 31, 1973 Japan ..... 48-13140

[51] Int. Cl.[2] ..... G03G 5/06

[52] U.S. Cl. ..... 96/1.5 R; 252/501

[58] Field of Search ..... 96/1.5, 1.5 C; 252/501

[56] References Cited

U.S. PATENT DOCUMENTS

| | | | |
|---|---|---|---|
| T888,013 | 7/1971 | Gilman | 96/1.5 |
| 2,803,542 | 8/1957 | Ullrich | 252/501 X |
| 2,822,300 | 2/1958 | Mayer et al. | 428/335 |
| 3,037,861 | 6/1962 | Hoegl et al. | 260/88.3 R X |
| 3,041,166 | 6/1962 | Bardeen | 96/1.5 |
| 3,121,007 | 2/1964 | Middleton et al. | 96/1.5 |
| 3,490,903 | 1/1970 | Myers et al. | 96/1.5 |
| 3,524,745 | 8/1970 | Cerlon et al. | 96/1.5 |
| 3,598,582 | 10/1971 | Herrick et al. | 96/1.5 |
| 3,634,134 | 1/1972 | Trubisky et al. | 96/1.5 X |
| 3,719,481 | 3/1973 | Makimo et al. | 96/1.5 X |
| 3,730,710 | 5/1973 | Ohta | 96/1.5 X |
| 3,741,762 | 6/1973 | Luebbe et al. | 96/1.5 |
| 3,753,709 | 8/1973 | Staudenmayer et al. | 96/1.5 |
| 3,764,315 | 10/1973 | Mort et al. | 96/1.5 |
| 3,870,516 | 3/1975 | Smith et al. | 96/1.5 |

FOREIGN PATENT DOCUMENTS

| | | | |
|---|---|---|---|
| 763,540 | 8/1971 | Belgium | 96/1.5 |
| 763,541 | 8/1971 | Belgium | 96/1.5 |
| 41-17907 | 10/1966 | Japan | 96/1.5 |

OTHER PUBLICATIONS

*Chemical Abstracts*, vol. 81, 1974, 129878*u*.

*Primary Examiner*—John T. Goolkasian
*Assistant Examiner*—J. R. Miller
*Attorney, Agent, or Firm*—Fitzpatrick, Cella, Harper & Scinto

[57] ABSTRACT

Electrophotographic photosensitive member characterized by a photoconductive layer which comprises polymers containing vinylcarbazole unit as a repeating moiety and arsenic and/or antimony chalcogen compound, said chalcogen compound being present in an amount of 1 to 30 volumetric parts per 100 volumetric parts of the polymer.

14 Claims, 5 Drawing Figures

(d)

(e)

PHOTOSENSITIVE MEMBER HAVING LAYER OF VINYL CARBAZOLE POLYMER CONTAINING ANTIMONY CHALCOGEN COMPOUND OF ANTIMONY AND SULFUR

This is a continuation, of application Ser. No. 436,747 filed Jan. 25, 1974, now abandoned.

BACKGROUND OF THE INVENTION

1. Field of the Invention

This invention relates to a photosensitive member for use in electrophotography. More particularly, it relates to a photosensitive member of high sensitivity based on a specific combination of known organic photoconductive materials and chalcogen compounds.

2. Description of the Prior Art

As an electrophotographic photosensitive member, there have been employed inorganic photoconductive materials such as Se, CdS, CdSe, ZnO, TiO, and CdTe or organic photoconductive materials such as polyvinylcarbazole, polyvinylanthrathene and the like. As is well known to one skilled in the art of electrophotography, a photosensitive member using an inorganic photoconductive material has substantially unimprovable disadvantages with respect to film forming ability, flexibility, transparency, mechanical strength, and the like and is subject to limited uses thereof although it is of excellent sensitivity. On the other hand, an organic photoconductive material is of considerably low sensitivity and needs a sensitizing treatment or a sensitizer although it does not have the drawbacks encountered in the inorganic photoconductive material as described above.

Recently, it has been proposed that in order to selectively utilize the advantages of the organic photoconductive material and inorganic photoconductive material, the organic photoconductive material is used in the form of a binder for a photoconductive layer and pigments of the inorganic photoconductive material are dispersed in the binder of the organic photoconductive material. The photosensitive member so prepared is excellent to some extent in all of the properties. Accordingly, this invention is intended to provide a more improved photosensitive member in which an organic photoconductive material and an inorganic photoconductive material are simultaneously employed as described above.

SUMMARY OF THE INVENTION

It is the primary object of this invention to provide an improved photosensitive member of high sensitivity.

It is further object of this invention to provide a photosensitive member of high quality which requires a rectifying property.

DETAILED DESCRIPTION OF THE PREFERRED EMBODIMENTS

Figure 1:
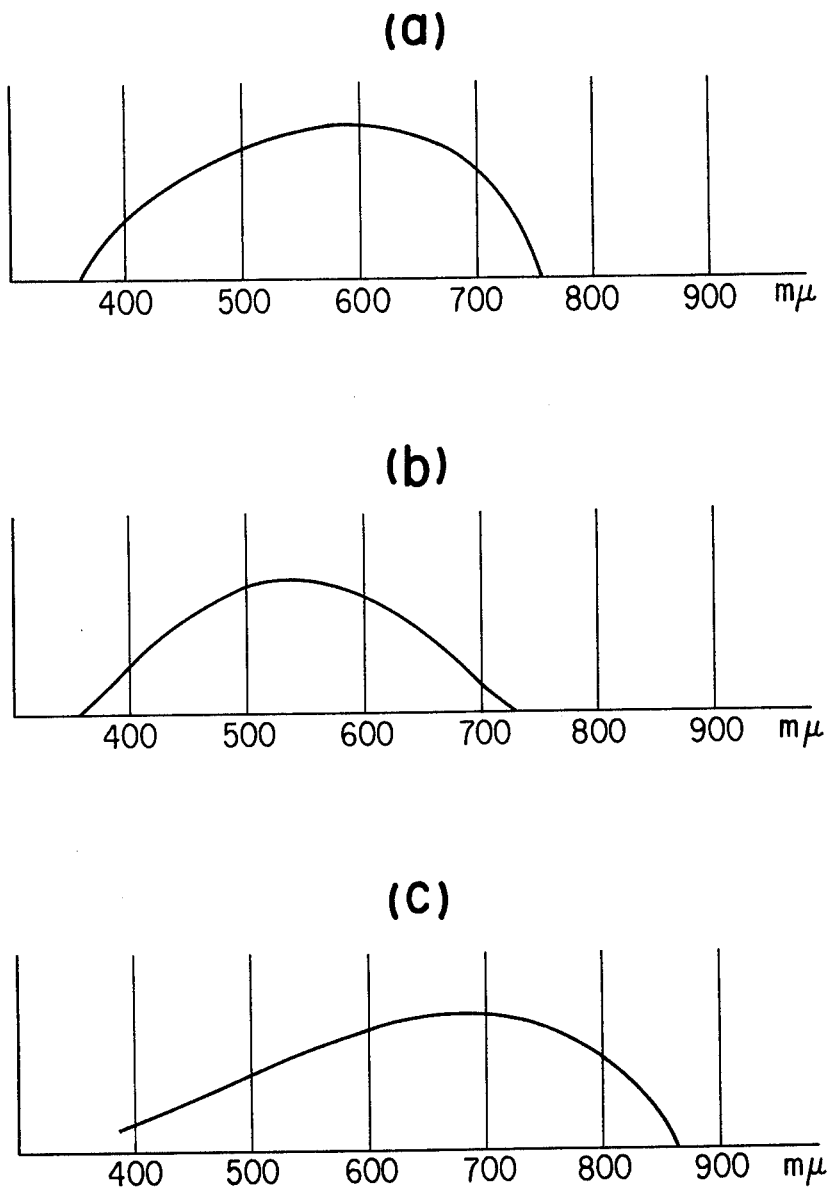
FIGS. 1(*a*) - 1(*e*) show the spectral sensitivity properties of the photosensitive member of this invention.
Figure 1:
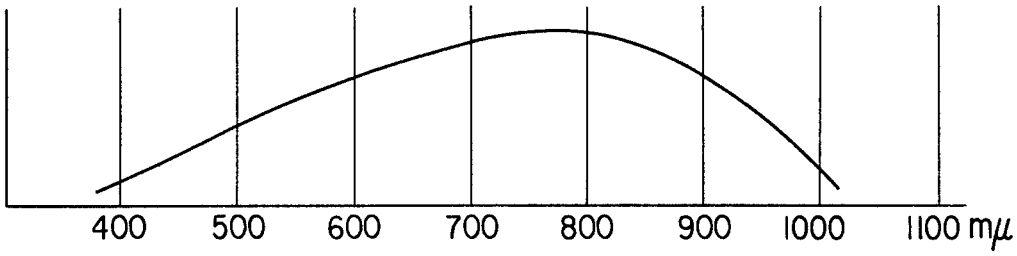
Figure 1:
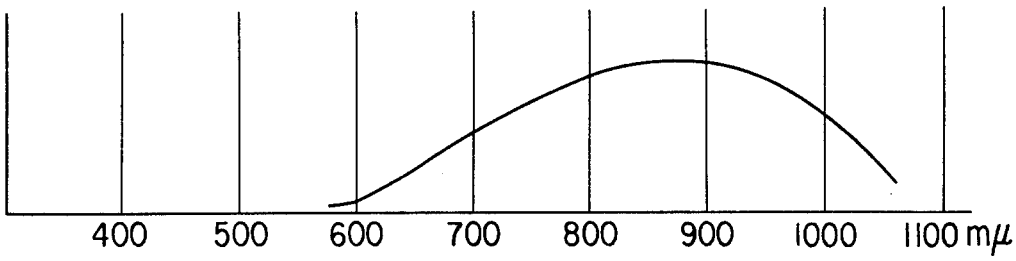

This invention is directed to a photosensitive member characterized by containing a photoconductive layer which mainly comprises polymers containing vinylcarbazole units as the repeating moiety and chalcogen compounds of arsenic and/or antimony in a proportion of 1 to 30 volumetric parts of the chalcogen compound to 100 volumetric parts of the polymer.

Thus, the feature of this invention resides in specific chalcogen compounds and organic photoconductive materials, particularly in specific chalcogen compounds. Although arsenic and antimony compounds have been used as an inorganic photoconductive material, they have been utilized merely as a photocell for a vidicon because of their low electric resistivity. Utilization thereof as photosensitive materials for electrophotography has not yet been seriously considered. These inorganic photoconductive materials in combination with vinylcarbazole polymers exhibit photoconductivity whose sensitivity is higher than those of any other inorganic photoconductive materials. As hereinafter described, the photosensitive member of this invention has a half-decay exposure amount of about 0.5 to 1 lux-sec.

Another feature of this invention resides in the fact that the photosensitive member of this invention has high spectral sensitivity in the range of visible wavelengths.

Moreover, the photosensitive member of this invention is excellent as a photosensitive member for use in electrophotographic processes which require rectifying properties (for example, processes as disclosed in Japanese Patent Publication Nos. 23910/1967 and 24748/1968).

The reason why the arsenic or antimony chalcogen compounds can provide high sensitivity to the system of this invention is not fully understood. However, the fact that the above chalcogen compound particles can be effectively used in an amount such that the particles do not come in contact with each other in the vinylcarbazole polymer system, indicates that the photo carrier is injected in the vinylcarbazole polymer system coated on the particles.

It has been recently reported that CdS, CdSe, CdTe, and the like can be employed in the photoconductive photosensitive systems described above (see, for example, J. Appl. Phys. 43(2)481 - 489). It has been, however, observed that particles of such compounds are subject to deterioration when the photosensitive member is prepared and more particularly the surface or crystal of the particles is deteriorated and broken during the step of milling the particles in the vinylcarbazole polymer system, which lowers the photosensitivity corresponding to the degree of deterioration. On the contrary, it has been observed that the sensitivity of the chalcogen compounds of this invention increases in proportion to the period of time of milling. Thus it is considered that arsenic and antimony compounds are materially different from CdS, CdSe, CdTe, and the like and they exhibit high chemical and physical affinity to vinylcarbazole based polymers.

Representative vinylcarbazole units contained in the vinylcarbazole based polymers as herein used are as follows: vinylcarbazoles such as 9-vinylcarbazole, 2-vinylcarbazole, 3-vinylcarbazole and the like; halogenated 9-vinylcarbazoles such as 3-chloro-9-vinylcarbazole, 3,6-dichloro-9-vinylcarbazole, 3-bromo-9-vinylcarbazole, 3,6-dibromo-9-vinylcarbazole, 3-iodo-9-vinylcarbazole, 3,6-diiodo-9-vinylcarbazole, 3-chloro-6-bromo-9-vinylcarbazole, 3-bromo-6-iodo-9-vinylcarbazole, 3-chloro-6-iodo-9-vinylcarbazole, 3,6,8-trichloro-9-vinylcarbazole and the like; nitrated 9-vinylcarbazoles such as 3-nitro-9-vinylcarbazole, 3,6-dinitro-9-vinylcarbazole, and the like; aminated 9-vinylcarbazoles such as 3-amino-9-vinylcarbazole, 3,6-diamino-9-vinylcarbazole, and the like; alkylamino-9-vinylcarbazoles such as 3-N-methylamino-9-vinylcarbazole, 3-N-ethylamino-9-vinylcarbazole, 3-N,N-dimethylamino-9-vinylcarbazole, 3-N,N-diethylamino-9-vinylcarbazole, and the like; 3-benzylideneamino-9-vinylcarbazole; 9-propenylcarbazole; cyano-9-vinylcarbazoles such as 3-cyano-9-vinylcarbazole, 3,6-dicyano-9-vinylcarbazole and the like; thiocyano-9-vinylcarbazoles such as 3-thiocyano-9-vinylcarbazole, 3,6-dithiocyano-9-vinylcarbazole, and the like; alkylvinylcarbazoles such as 2-vinyl-9-methylcarbazole, 3-vinyl-9-ethylcarbazole, and the like; and the like.

The vinylcarbazole based polymers may be prepared by polymerizing a vinylcarbazole unit or copolymerizing two or more vinylcarbazole units or copolymerizing one or more vinylcarbazole units with other mononer units.

Representative other monomer units are as follows:

methylacrylate, ethylacrylate, ethylaminoethylacrylate, vinylcinnamate, methyl methacrylate, acrylonitrile, styrene, vinylpyridine, vinylpyrrolidone, and the like.

The copolymers preferably contain more than 50 mol% of the vinylcarbazole units.

Representative polymers containing vinylcarbazole units are as follows:

poly-9-vinylcarbazole, 9-vinylcarbazole copolymers, 3-nitro-9-vinylcarbazole copolymers, nitrated poly-9-vinylcarbazole, poly-9-vinyl-3-aminocarbazole, 3-N-methylamino-9-vinylcarbazole copolymers, halogen substituted poly-9-vinylcarbazole, 3,6-dibromo-9-vinylcarbazole copolymers, 3-iodo-9-vinylcarbazole copolymers, poly-3,6-diiodo-9-vinylcarbazole, poly-3-benzylidene-amino-9-vinylcarbazole, poly-9-propenylcarbazole, graft copolymer of 9-vinylcarbazole and ethylacrylate (molar ratio of 90 : 10), vinylanthracene-9-vinylcarbazole copolymers, 2-(or 3-)vinyl-9-alkylcarbazole (alkyl group is primary alkyl group such as methyl, ethyl, propyl and the like) homopolymers or copolymers, 3-cyano-9-vinylcarbazole homopolymers or copolymers, 3,6-dicyano-9-vinylcarbazole homopolymers or copolymers, 3-thiocyano-9-vinylcarbazole homopolymers or copolymers and the like.

Representatives of arsenic and antimony chalcogen compounds are given below:

As-S, As-Se, As-Te, Sb-S, Sb-Se, Sb-Te, As-S-Se, As-S-Te, As-Se-Te, Sb-S-Se, Sb-S-Te, Sb-Se-Te, As-Sb-S, As-Sb-Se, As-Sb-Te, As-S-Se-Te, Sb-S-Se-Te, As-Sb-S-Se, As-Sb-S-Te and As-Sb-Se-Te based chalcogen compounds.

The chalcogen compound may contain if desired metal elements such as In, Sn, Bi, Tl, Pb, Ga, Ge, Si, Ag, Cu, Zn, Mn, Ni, and Mg. The amount of the element ranges generally from 0.00001 to 30 atomic %. Particularly, metal elements such as In, Sn, Pb, Ag, Cu, Zn, Mn, Ni and Mg are preferably added in a small amount of less than 1 atomic %.

Representative chalcogen compounds are $As_2S_3$, $As_2Se_3$, $As_2Te_3$, $As_2S_2Se$, $As_2SSe_2$, $As_2Se_2Te$, $As_4S_6$, $As_4S_5Se$, $AsS_3Se_3$, $As_4SSe_5$, $As_4Se_5Te$, $Sb_2S_3$, $Sb_2Se_3$, $Sb_2Te_3$, $Sb_2S_2Se$, $Sb_2S_2Se$, $AsSbS_3$, $AsSbTe_3$, $As_3SbSe_5Te$, AsSbSe hd 3, $Sb_2SSeTe$, and the like.

The chalcogen compounds as herein used are compounds composed of arsenic and/or antimony and chalcogen elements (S, Se and Te).

The particle size of the chalcogen compound pigment generally ranges from 0.1 to 10 $\mu$ and preferably from 0.5 to 5 $\mu$. A photosensitive member is generally prepared by coating a photosensitive liquid on a substrate and by drying the resulting coating. The photosensitive liquid is prepared by adding the arsenic or antimony chalcogen compound pigment to a solution of the vinylcarbazole based polymer and by fully stirring the resulting mass. The chalcogen compound is added to the polymer in an amount of 1 to 30 volumetric parts, preferably 5 to 20 volumetric parts per 100 volumetric parts of the polymer. Dispersion of the pigment may be carried out by conventional stirring means such as roll mill, ball mill and the like.

The photosensitive liquid as prepared above may contain if plasticizers necessary. The prasticizer is preferably added in a range of 50 to 200 parts by weight per 100 parts by weight of the polymer.

Representatives of the plasticizers are chlorinated paraffin, low molecular weight polystyrene, low molecular weight poly-$\alpha$-methylstyrene, dibutylphthalate, cumarone resin and the like.

The photosensitive layer is generally formed in a thickness of 2 to 30 $\mu$. The substrate may be selected from plastic films which are conductively treated with a metal plate, glass plates, ceramic sheets and the like.

EXAMPLE 1

A solution with the following composition was prepared.

Poly-9-vinylcarbazole (trade name, Luvican M-170, manufactured by BASF) . . . 6g Poly-$\alpha$-methylstyrene (plasticizer: trade name, resin 276-V4, Dow Chemical) . . . 2g Chlorobenzene . . . 45g Toluene . . . 45g $Sb_2S_3$ was added to the above solution in an amount of 10 volumetric parts per 100 volumetric parts of poly-9-vinylcarbazole and dispersed therein with a ball mill for 5 hours to prepare a photosensitive liquid. The photosensitive liquid so prepared was coated onto an aluminum substrate to form a 15 $\mu$ thick dry layer and there was then produced an electrophotographic photosensitive member.

The photosensitive member was charged with a Corona discharge of $-6.5$ KV and thereafter it was printed with a transparent image under an illumination intensity (on the exposure surface) of lux-sec. and cascade-developed to obtain a fogless and clear image.

The photosensitive member was of high sensitivity such that the half-decay exposure amount of the member was only 1.2 lux-sec. The spectral sensitivity thereof, as illustrated in FIG. 1(*a*), was excellent over the entire visible light range.

In FIG. 1, the abscissa indicates wave length of light and the ordinate indicates specific sensitivity.

The half-decay exposure amount of a 40 $\mu$ thick Se photo-sensitive member, a 10 $\mu$ thick Zn-silicone photosensitive member sensitized with Rhodamine B and a 8 $\mu$ thick polyvinylcarbazole photosensitive member sensitized with Crystal Violet were measured to be 30 lux-sec, 42 lux-sec and 280 lux-sec, respectively.

EXAMPLE 2

By adding 1g of a fine powder of $As_2Se_3$ having an average diameter of about 2 $\mu$ to 100g of the carbazole solution as shown in Example 1, there was prepared a photosensitive liquid in the same manner as in Example 1. The thus-prepared photosensitive liquid was coated on 10 substrates numbered (1) to (10) as shown in the following Table to form a 8 μ thick photosensitive layer so that 10 photosensitive members were prepared. The table also indicates the measured values of the contact potential difference of the substrates to gold.

| No. | Substrates | Contact potential difference (mv) |
|---|---|---|
| 1 | Al | 900 |
| 2 | PbO vapor-deposited Al | 840 |
| 3 | CdS vapor-deposited Al | 550 |
| 4 | PbO vapor-deposited Ni | 510 |
| 5 | Ni | 250 |
| 6 | $Cu_2S$ vapor-deposited Ni | 100 |
| 7 | Te vapor-deposited Ni | 50 |
| 8 | CuO vapor-deposited Al | −130 |
| 9 | CuO vapor-deposited Al | −220 |
| 10 | Crystal Se vapor-deposited Ni | −290 |

By charging the above 10 photosensitive members in a dark place with a Corona discharger applied with voltages of +6.5 KV, the saturation and −6.5 KV, saturation charge potential was measured. The results are shown in the following Table. In the Table, the numbers (1) to (10) indicate photosensitive members provided with the substrates (1) to (10), respectively. (+)Potential and (−)potential indicate saturation charge potential.

| Photosensitive Member | (+) Potential (V) | (−) Potential (V) |
|---|---|---|
| 1 | +1450 | −1250 |
| 2 | +1420 | − 960 |
| 3 | +1400 | − 780 |
| 4 | +1300 | − 600 |
| 5 | +1250 | − 750 |
| 6 | +1250 | − 750 |
| 7 | +1300 | − 600 |
| 8 | +1450 | − 280 |
| 9 | +1400 | − 220 |
| 10 | +1350 | − 200 |

The results show that the negative charge potential is lowered as the contact potential difference of the substrate to gold becomes more negative whereas the positive charge is substantially constant. In view of these results, it is considered that when the contact potential difference negative a hole is injected only from the side of substrate, i.e. there occurs rectification contact.

EXAMPLE 3

In place of $Sb_2S_3$ in Example 1, $As_2Se_3$ was dispersed in poly-9-vinylcarbazole in a proportion of 10 volumetric parts per 100 volumetric parts of poly-9 -vinylcarbazole to form a photosensitive liquid. The resulting liquid was coated on a CuO vapor-deposited nickel substrate (contact potential difference to gold, -31 220 mv) in a dry film thickness of 30 μ. Then, a 25 μ thick insulating polyester film was overlaid on the dry film by interposing an adhesive layer to prepare a photosensitive plate.

The thus-prepared plate was charged with corona discharge of −5 KV and thereafter subjected to AC corona discharging while applying an imagewise exposure (30 lux sec) and there was thus obtained a latent image having an electrostatic contrast of 600 V between a light portion and a dark portion. The latent image could be developed with positively charged toners to provide a sharp image.

EXAMPLE 4

In the poly-9-vinylcarbazole solution of Example 1 were dispersed $As_2S_3$, $As_2S_2Se$, $As_2S_{0.5}Se_{2.5}$ and $As_2Se_3$ in an amount of 10 volumetric parts per 100 volumetric parts of poly-9-vinylcarbazole. The resulting liquid was coated on aluminum plates to prepare four photosensitive plates whose thickness was 1.5 μ.

The four photosensitive plates were positively charged by corona discharge of 6.5 KV an subjected to imagewise exposure of 50 lux sec. The resulting image was developed with negatively charged toner and there was then obtained a fogless image.

The spectral properties of each of the photosensitive plates are illustrated by (b), (c), (d) and (e) of FIG. 1, respectively.

EXAMPLE 5

On employing in place of poly-9-vinylcarbazole of the photosensitive liquid of Example 1 (i) poly-9-vinyl-3,6-dichlorocarbazole, (ii) poly-9-vinyl-3,6-dibromocarbazole, (iii) poly-9-vinyl-3,6-dicyanocarbazole, (iv) poly-9-vinyl-3-methylcarbazole, and (v) copolymer of 9-vinylcarbazole and ethylacrylate (molar ratio = 90 : 10), there were obtained excellent images in each cases.

The half-decay exposure amount of the cases is shown in Table below.

| Vinylcarbazole based polymer | Half-decay exposure amount (lux. sec) |
|---|---|
| Poly-9-vinyl-carbazole | 1.2 |
| I | 2.5 |
| II | 2.6 |
| III | 2.8 |
| IV | 0.8 |
| V | 10.1 |

EXAMPLE 6

In place of $Sb_2S_3$ of the photosensitive liquid of Example 1, 20 volumetric parts of $Sb_2Se_3$ was dispersed and coated on a 8 μ thick aluminum plate. The resulting photosensitive plate was of somewhat low saturation charge amount. Therefore, poly-9-vinylcarbazole was coated on the above plate in a thickness of 8 μ to prepare a photosensitive plate. The thus-prepared plate was charged with corona discharge of −6.5 KV and then as in Example 1, there was obtained a similar image.

EXAMPLE 7

Relationship between ball milling period and photosensitivity with the photosensitive liquid of Example 1 is shown. For comparison, a 10 mol% CuCl doped CdSe was employed. The results are shown in Table below.

Relationship between ball milling period and half-decay exposure amount (lux sec)

| Period (hours) | $Sb_2S_3$ | CdSe - CuCl |
|---|---|---|
| 1 | 18.5 | 22.0 |
| 5 | 1.2 | 16.0 |
| 24 | 1.2 | 110.0 |
| 48 | 1.1 | more than 300 |
| 96 | 1.2 | more than 300 |

We claim:

1. An electrophotographic photosensitive member comprising an electrically-conductive substrate and a photoconductive layer which consists essentially of an organic photoconductive polymer selected from the group consisting of homopolymers of at least one vinylcarbazole monomer and copolymers thereof containing more than 50% of the vinylcarbazole monomer, said polymer having dispersed therein from 1 to 30 parts by volume, per 100 parts by volume of said polymer, of an antimony chalcogen compound consisting essentially of antimony and sulfur.

2. The electrophotographic photosensitive member of claim 1, wherein said chalcogen compound is a pigment having a particle size of from 0.1 to 10 microns.

3. The electrophotographic photosensitive member of claim 1, wherein the half-decay exposure amount of said member is from 0.5 to 1 lux-sec.

4. The electrophotographic photosensitive member of claim 1, wherein said polymer is a homopolymer of a vinylcarbazole monomer or a copolymer thereof.

5. The electrophotographic photosensitive member of claim 1, wherein said polymer is selected from the group consisting of homopolymers of vinylcarbazole monomers and substituted vinylcarbazole monomers and copolymers thereof, wherein said substituent is selected from the group consisting of halogen nitro, amino, alkylamino, 3-benzylideneamino, 9-propenyl, cyano, thiocyano, and alkyl.

6. The electrophotographic photosensitive member of claim 1, wherein the particle size of said chalcogen compound is from 0.5 to 5 microns.

7. The electrophotographic photosensitive member of claim 1, wherein the amount of said chalcogen compound in said photoconductive layer is from 5 to 20 parts by volume per 100 parts by volume of said photoconductive polymer.

8. The electrophotographic photosensitive member of claim 1, wherein the contact potential difference of said substrate as compared to gold is less than 200 mV.

9. The electrophotographic photosensitive member of claim 1, wherein said polymer is a homopolymer or copolymer of at least one vinylcarbazole monomer selected from the group consisting of 9-vinyl carbazole, nitro-9-vinylcarbazole, amino-9 vinylcarbazole, alkylamino-9-vinylcarbazole, halogenated-9-vinylcarbazole, 3-benzylideneamino-9-vinylcarbazole, 9-propenylcarbazole, cyano-9-vinylcarbazole, thiocyano-9-vinylcarbazole, and alkylvinylcarbazole.

10. The electrophotographic photosensitive member of claim 9, wherein said polymer is a copolymer of at least one vinylcarbazole monomer with at least one monomer selected from the group consisting of methyacrylate, ethylacrylate, ethylamino-ethylacrylate, vinylcinnamate, methyl methacrylate, acrylonitrile, styrene, vinylpyridine and vinylpyrrolidone.

11. An electrophotographic photosensitive member comprising an electrically-conductive substrate and a photoconductive layer which consists essentially of an organic photoconductive polymer selected from the group consisting of homopolymers of at least one vinylcarbazole monomer and copolymers thereof containing more than 50% of the vinylcarbazole monomer, said polymer having dispersed therein from 1 to 30 parts by volume, per 100 parts by volume of said polymer, of an antimony chalcogen compound composed of antimony and sulfur, said chalcogen compound further containing from 0.00001 to 30 atomic percent of a metal element selected from the group consisting of In, Sn, Bi, Tl, Pb, Ga, Ge, Si, Ag, Cu, Zn, Mn, Ni, and Mg.

12. An electrophotographic photosensitive member comprising an electrically-conductive substrate and a photoconductive layer which consists essentially of an organic photoconductive polymer selected from the group consisting of homopolymers of at least one vinylcarbazole monomer and copolymers thereof containing more than 50% of the vinylcarbazole monomer, said polymer having dispersed therein from 1 to 30 parts by volume, per 100 parts by volume of said polymer, of an antimony chalcogen compound consisting essentially of antimony and sulfur, said chalcogen compound further containing less than 1 atomic percent of a metal selected from the group consisting of In, Sn, Pb, Ag, Cu, Zn, Mn, Ni and Mg.

13. the electrophotographic photosensitive member of claim 1, wherein the thickness of said photoconductive layer is from 2 to 30 microns.

14. The electrophotographic photosensitive member of claim 1, wherein said polymer is selected from the group consisting of poly-9-vinylcarbazole, copolymers thereof, 3-nitro-9-vinylcarbazole copolymers, nitrated poly-9-vinylcarbazole, poly-9-vinyl-3-aminocarbazole, 3-N-methylamino-9-vinylcarbazole copolymers, halogen-substituted poly-9-vinylcarbazole, 3,6-dibromo-9-vinylcarbazole copolymers, 3-iodo-9-vinylcarbazole copolymers, poly-3, 6-diodo-9-vinylcarbazole, poly-3-benzylideneamino-9-vinylcarbazole, poly-9-propenylcarbazole, graft copolymers of 9-vinylcarbazole and ethylacrylate having a molar ratio of 90/10, vinylanthracene-9-vinylcarbazole copolymers, 2 (or 3)-vinyl-9-alkylcarbazole homopolymers and copolymers, 3-cyano-9vinylcarbazole homopolymers and copolymers, 3,6-dicyano-9-vinylcarbazole homopolymers and copolymers, and 3-thiocyano-9-vinylcarbazole homopolymers and copolymers.

* * * * *

UNITED STATES PATENT AND TRADEMARK OFFICE

CERTIFICATE OF CORRECTION

PATENT NO. : 4,097,277

DATED : June 27, 1978

INVENTOR(S) : YOSHIO TAKASU, ET AL.

It is certified that error appears in the above-identified patent and that said Letters Patent are hereby corrected as shown below:

Column 1, line 22, change "polyvinylanthrathene" to -- polyvinylanthracene --.

Column 3, line 17, change "mononer" to -- monomer --; line 45, change "Representatives of" to -- Representative --; line 63, change "AsSbSe hd 3," to -- $AsSbSe_3$ --.

Column 4, line 14, change "contain if plasticizers necessary" to -- contain plasticizers if necessary. --; same line, change "prasticizer" to -- plasticizer --; line 17, change "Representatives of the" to -- Representative --; line 46, change "of lux-sec" to --of 10 lux-sec--.

Column 5, line 43, change "negative a hole" to -- is negative, a hole --; line 44, change "of substrate" to -- of the substrate --; line 52, change "gold, -31 220" to -- gold, -220 mv) --.

Column 8, line 31, change "the" to -- The --; line 48, change "3-cyano-9vinyl-carbazole" to -- 3-cyano-9-vinylcarbazole- Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*